US005294102A

United States Patent [19]

Ifkovits, Jr. et al.

[11] Patent Number: 5,294,102

[45] Date of Patent: Mar. 15, 1994

[54] SHEET FEEDER SEPARATOR ROLLER

[75] Inventors: Edward M. Ifkovits, Jr.; Edward F. Ifkovits, both of New Fairfield; Anthony M. Macelis, Watertown, all of Conn.

[73] Assignee: Pitney Bowes Inc., Stamford, Conn.

[21] Appl. No.: 105,561

[22] Filed: Aug. 13, 1993

[51] Int. Cl.[5] ..... B65H 3/04

[52] U.S. Cl. ..... 271/35; 271/121

[58] Field of Search ..... 271/121-125, 271/35

[56] References Cited

U.S. PATENT DOCUMENTS 3,640,524 2/1972 Fredrickson ..... 271/121
3,908,983 9/1975 Long ..... 271/125 X
4,651,983 3/1987 Long ..... 271/125 X
5,195,737 3/1993 Ifkovits ..... 271/125 X

*Primary Examiner*—Richard A. Schacher
*Attorney, Agent, or Firm*—Charles R. Malandra, Jr.; Melvin J. Scolnik

[57] ABSTRACT

Apparatus for singulating paper sheets. The apparatus includes: a deck for supporting a plurality of paper sheets; a device for feeding the plurality of paper sheets along the deck; a retarding roller situated above the deck for retarding the plurality of paper sheets; and a feeding roller situated below the retarding roller for feeding the lowermost of the paper sheets past the retarding roller, which has a metal sleeve with a grit coating having a hardness on the Rockwell "C" scale of at least 60 and a grit size according to the U.S. Standard System between 10 and 320.

4 Claims, 3 Drawing Sheets

SHEET FEEDER SEPARATOR ROLLER

BACKGROUND OF THE INVENTION

The instant invention relates to a singulating feeder for feeding sheets of paper seriatim from an upstream supply to a downstream apparatus and further processing. More particularly, the invention relates to the separating roller and stone used in such a feeder to effect singulation.

Mechanisms for the feeding of paper documents generally fall into two categories, those being vacuum fed and friction fed. The following description of the prior art will deal only with those types of feeders and material handlers which are considered to be friction-type feeders and which include singulators.

Friction feeders are preferred when it comes to feeding single paper documents. Friction feeders, as the name implies, rely on the interaction of several components that result in the singulation of paper documents. Two methods of singulation are provided by friction feeders. One style is via top feed and the second style is via bottom feed. A friction feeder is designed to operate as a top feed or a bottom feed, but it cannot operate in both modes. The components are usually a drive roller and a retarding device. The retarding device is of a material which provides a high coefficient of friction between the paper being fed and the drive roller.

In a bottom feed configuration, the paper begins as a vertical stack placed on a plurality of belts which usually are supported by a feeder table. This plurality of belts then advance the stack of paper toward a retarding device. As the plurality of belts advance the stack of paper under the retarding device, the friction between the belts and the bottom of the stack of paper tends to pull paper off the bottom of the stack. The retarding device provides the friction that acts to hold back the stack of paper. Therefore, the number of paper documents that are pulled from the bottom of the vertical stack is determined by the physical distance between the belts and the retarding device. If the distance is substantially the thickness of a single piece of paper, or the thickness of the material being singulated, a single paper will be delivered from the bottom of the stack. The single sheet delivery is generally the desired result. If the distance between the belts and the retarding device is the thickness of several pieces of paper or of the documents to be singulated, then a stream of paper documents will be delivered from the stack.

The typical retarding device in a bottom feed configuration is a stationary stone, and a feed roller located beneath the stone advances the lower most of the sheets of paper. A long standing problem associated with the use of a feed roller is that it becomes glazed over with paper fibers, ink or other foreign matter. Thus, the instant invention provides a feed roller which overcomes the problems associated with the conventional feed rollers and yet continues to provide reliable feeding and singulation of paper sheets.

SUMMARY OF THE INVENTION

Accordingly, the instant invention provides apparatus for singulating paper sheets. The apparatus comprises: a deck for supporting a plurality of paper sheets; means for feeding said plurality of paper sheets along said deck; a retarding roller situated above said deck for retarding said plurality of paper sheets; and a feeding roller situated below said retarding roller for feeding the lowermost of said paper sheets past said retarding roller, said feeding roller having a metal sleeve with a grit coating having a hardness on the Rockwell "C" scale of at least 60 and a grit size according to the U.S. Standard System between 10 and 320.

DETAILED DESCRIPTION OF THE PREFERRED EMBODIMENT

Figure 1:
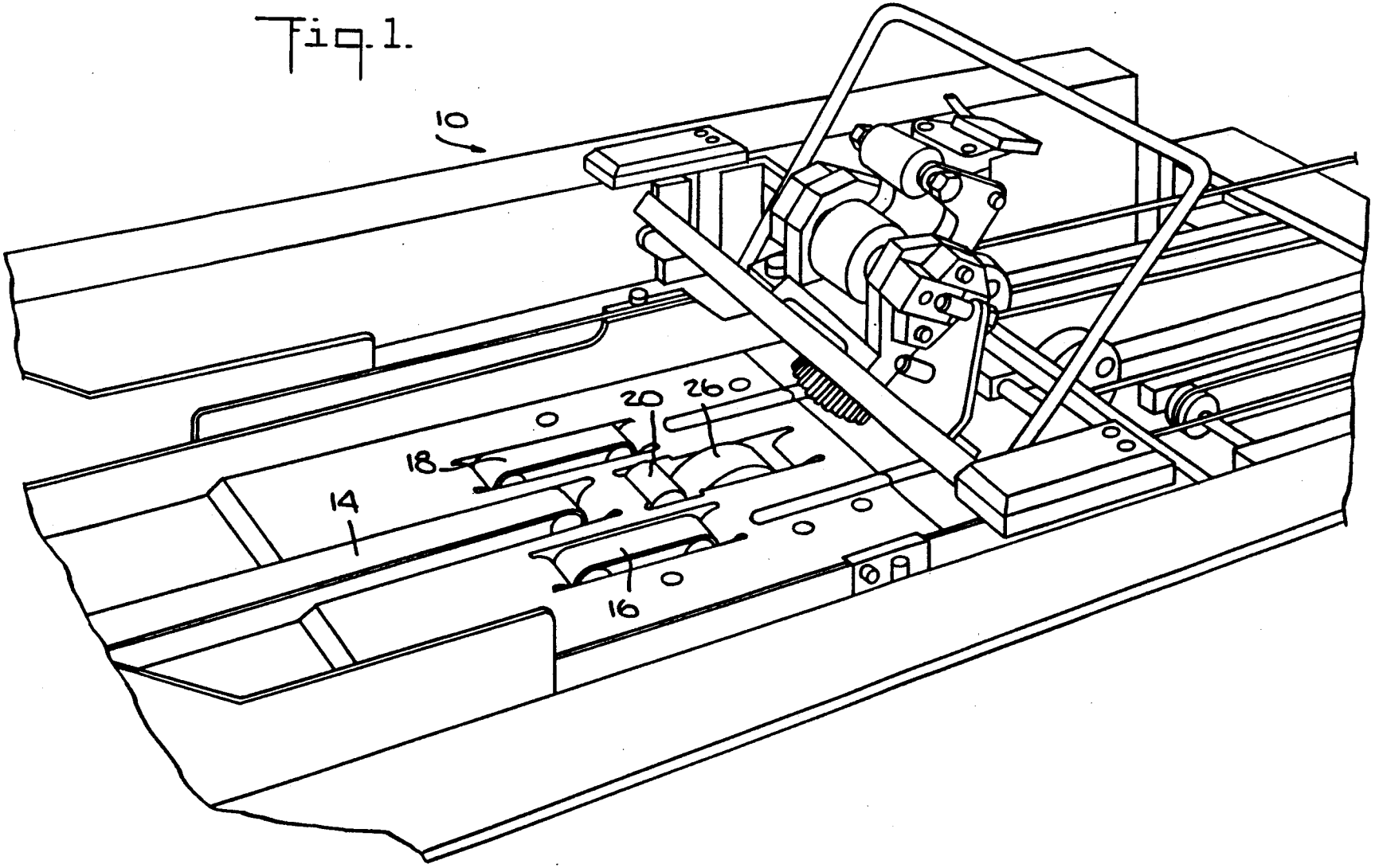
FIG. 1 is a perspective view of a singulating feeder in accordance with the instant invention.
Figure 2:
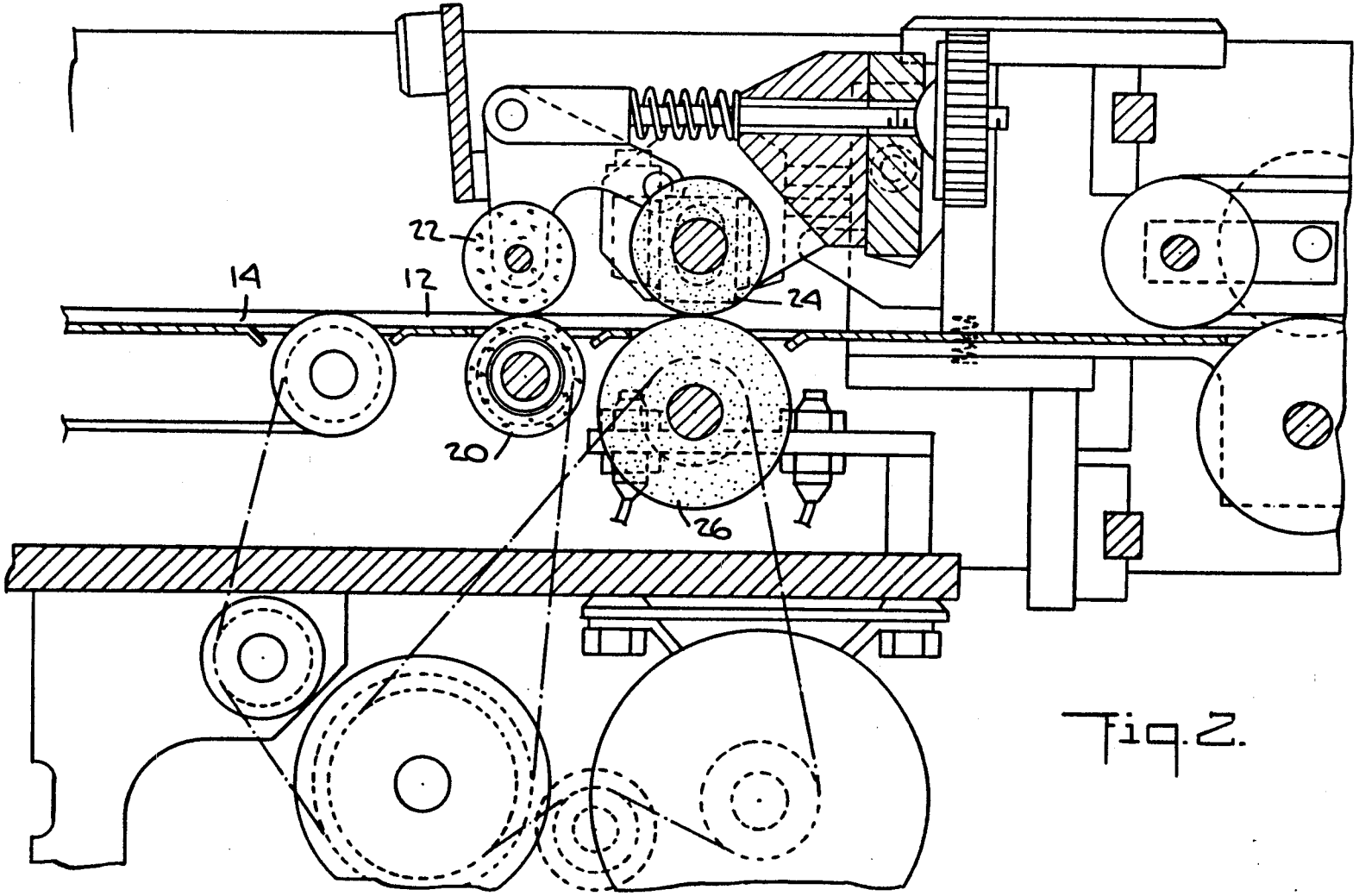
FIG. 2 is a vertical, sectional view of the feeder seen in FIG. 1.

In describing the preferred embodiment of the instant invention, reference is made to the drawings, wherein there is seen in FIGS. 1 and 2 a paper feeding module 10 for feeding and singulating a stream of paper sheets 12 (see FIG. 2) from an upstream position to a downstream position where they will be further processed and ultimately inserted into an envelope. An intermittently driven belt 14 (see FIG. 1) feeds the sheets 12 toward a pair of intermittently driven belts 16 and 18. At the downstream end of the belts 16 and 18 are a separating roller 20 and a separating stone 22 located above the roller 20 (see FIG. 2), which will be discussed in detail hereinbelow. The separating roller 20 is intermittently driven in the same manner as the belts 14, 16 and 18.

Downstream of the separator stone 22 are a pair of continuously running, take-away rollers 24 and 26 for conveying the sheets of paper 12 downstream in singulated fashion seriatim.

Figure 3:
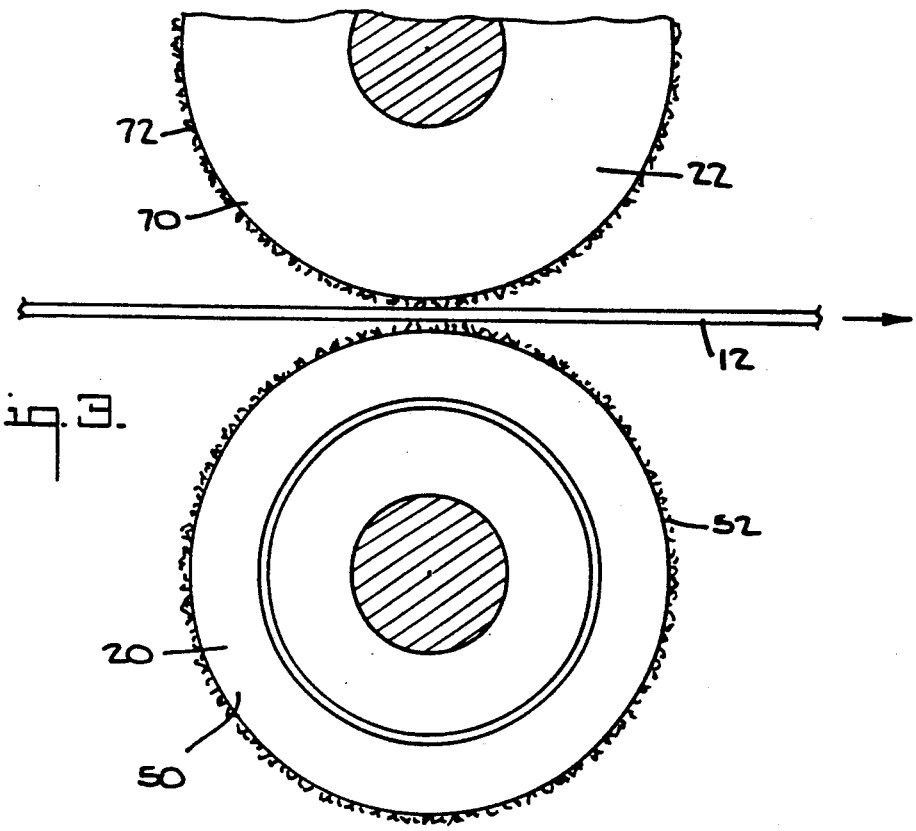
FIG. 3 is an enlarged, vertical, sectional view of a separating stone and feeder roller in accordance with the instant invention.

Referring now to FIG. 3, there is seen the separating stone 22 and the adjacent separating roller 20. The metal sleeve 50 of the separating roller 20 includes a coating 52 of tungsten carbide grit. The separating stone 22, in the preferred embodiment, also consists of a metal sleeve 70 having a surface coating 72 of tungsten carbide grit. The preferred embodiment utilizes identical rollers for the separating roller 20 and the separating stone 22 which makes these parts interchangeable and minimizes costs of these parts. Examples of other materials that can be used for the surfaces of both the separating roller 20 and the separating stone 22 include silicon carbide and a variety of ceramic materials, such as aluminum oxide. Generally, a grit coating should have a hardness on the Rockwell "C" scale of at least 60, and preferably at least 90, and a grit size according to the U.S. Standard System between 10 and 320, with the preferred grit size being between 46 and 100. It is understood that each grit size includes a range of particle size.

Figure 4:
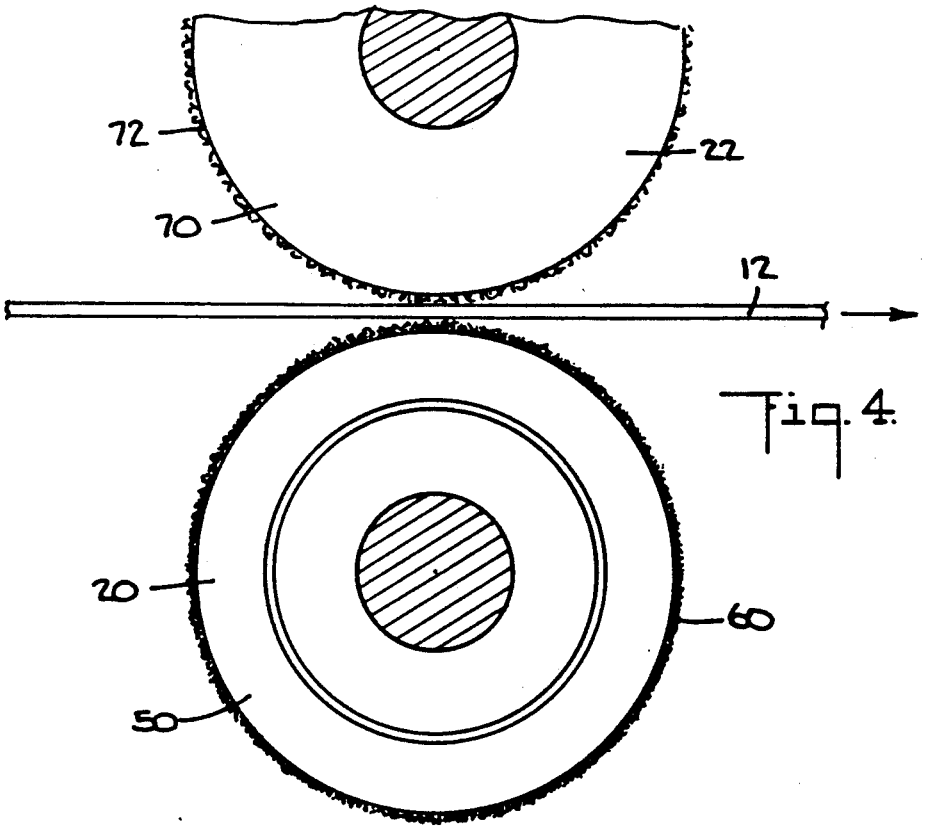
FIG. 4 is similar to FIG. 4 but shows the separating stone and feeder roller after they have been in use for a substantial period of time and their surfaces have accumulated deposits of foreign substances.

Referring now to FIG. 4, it can be seen that the coating 52 of the separating roller 20 has become covered with foreign matter 60 such as paper fiber and ink, but because of the nature of the tungsten carbide coating 52, there is still retained in the roller 20 the ability to function as a feeding roller. More specifically, the coating 52 is sufficiently rough so that even if it becomes glazed over with foreign matter 60, sufficient roughness remains so that the coating 52 does not become smooth and slippery and incapable of functioning as a feeding roller.

It should be understood by those skilled in the art that various modifications may be made in the present invention without departing from the spirit and scope thereof, as described in the specification and defined in the appended claims.

What is claimed is:

1. Apparatus for singulating paper sheets, comprising:

a deck for supporting a plurality of paper sheets;

means for feeding said plurality of paper sheets along said deck;

a retarding roller situated above said deck for retarding said plurality of paper sheets; and a feeding roller situated below said retarding roller for feeding the lowermost of said paper sheets past said retarding roller, said feeding roller having a metal sleeve with a grit coating having a hardness on the Rockwell "C" scale of at least 60 and a grit size according to the U.S. Standard System between 10 and 320.

2. The apparatus of claim 1, wherein said retarding roller includes a metal sleeve with a grit coating having a hardness on the Rockwell "C" scale of at least 90 and a grit size according to the U.S. Standard System between 46 and 100.

3. The apparatus of claim 1, wherein said retarding roller and said feeding roller have identical sleeves and grit coatings.

4. The apparatus of claim 3, wherein said grit coating comprises tungsten carbide.

* * * * *